US007815136B2

(12) United States Patent
Arnston

(10) Patent No.: US 7,815,136 B2
(45) Date of Patent: Oct. 19, 2010

(54) CUTTING WHEEL CONTAINING SECONDARY CUTTERS

(75) Inventor: Chris Arnston, Jamestown, ND (US)

(73) Assignee: DuraTech Industries International, Inc., Jamestown, ND (US)

( * ) Notice: Subject to any disclaimer, the term of this patent is extended or adjusted under 35 U.S.C. 154(b) by 0 days.

(21) Appl. No.: 12/165,810

(22) Filed: Jul. 1, 2008

(65) Prior Publication Data

US 2009/0289134 A1 Nov. 26, 2009

Related U.S. Application Data

(60) Provisional application No. 61/054,652, filed on May 20, 2008.

(51) Int. Cl.
*B02C 18/16* (2006.01)

(52) U.S. Cl. ..... 241/294; 241/295

(58) Field of Classification Search ..... 241/30, 241/195, 197, 294, 295; 144/241, 218, 235
See application file for complete search history.

(56) References Cited

U.S. PATENT DOCUMENTS

| | | | | |
|---|---|---|---|---|
| 60,827 | A | 1/1867 | Bee | |
| 74,523 | A | 2/1868 | Emerson et al. | |
| 1,315,734 | A | 9/1919 | Mattison | |
| 2,659,398 | A | 11/1953 | Marvin | |
| 3,633,833 | A | 1/1972 | Ehrlich | |
| 3,822,042 | A | 7/1974 | Roy | |
| 4,269,244 | A | 5/1981 | Kinsella | |
| 5,193,597 | A | 3/1993 | Strong | |
| 5,617,908 | A | 4/1997 | Toogood | |
| 5,709,255 | A | 1/1998 | Toogood | |
| RE36,659 | E | 4/2000 | Toogood | |
| 6,550,504 | B1 | 4/2003 | Leonardi et al. | |
| 7,048,218 | B2 * | 5/2006 | Hunag | 241/295 |
| 2007/0063084 | A1 * | 3/2007 | New | 241/295 |

* cited by examiner

*Primary Examiner*—Mark Rosenbaum
(74) *Attorney, Agent, or Firm*—Z. Peter Sawicki; Westman, Champlin & Kelly, P.A.

(57) ABSTRACT

The present invention includes a cutting wheel device for grinding materials, the cutting wheel comprising a plurality of discrete plates mounted on an axle and cutting heads positioned between the plates. The cutting heads having a portion extending beyond the periphery of the plate. Secondary cutters are attached to the cutting head to project over an adjacent discrete plate for keeping debris from lodging between adjacent cutting heads.

2 Claims, 3 Drawing Sheets

CUTTING WHEEL CONTAINING SECONDARY CUTTERS

CROSS-REFERENCE TO RELATED APPLICATION

The present application is based on and claims the benefit of U.S. provisional patent application Ser. No. 61/054,652, filed May 20, 2008, the content of which is hereby incorporated by reference in its entirety.

BACKGROUND OF THE INVENTION

The present invention relates to cutting wheels for grinders that grind items such as lumber, logs, construction debris and the like.

Such cutting wheels are used in grinders to grind debris in situations that include large-scale clearing after natural disasters and at construction sites. The cutting wheel, although termed a cutting wheel, is in actuality a cylindrical wheel comprised of a number of discrete plates, each plate including at least one cutting head. Due to the type of debris being ground, the wheels have to be quite sturdy since the grinding operation includes grinding of objects such as wood, yard waste, construction debris, storm damage, and mill scraps.

The cutting wheel includes cutting heads that are positioned between the plates. The plates with cutting heads are then secured to each other to form the cylindrical grinding wheel. The cutting heads are staggered with respect to each extending beyond the periphery of the plates for an efficient cutting/grinding design.

Due to the variety of materials being ground, problems arise with debris becoming lodged between adjacent cutting heads. Debris becomes lodged even though the heads may be somewhat staggered circumferentially. The lodged debris results in more energy having to be used to maintain a selected rotational speed of the grinding wheel for efficient grinding. Eventually, enough debris becomes lodged between the cutting heads that the lodged material prevents other material from reaching the blades. The grinding wheel has to be stopped and manually cleared which is time consuming.

SUMMARY OF THE INVENTION

The present invention includes a cutting wheel device for grinding materials, the cutting wheel comprising a plurality of discrete plates mounted on an axle and cutting heads positioned between the plates. The cutting heads each have a portion extending beyond the periphery of the plate. Secondary cutters are attached to the cutting heads to project over an adjacent discrete plate for keeping debris from lodging between adjacent cutting heads.

DETAILED DESCRIPTION OF ILLUSTRATIVE EMBODIMENTS

Figure 1:
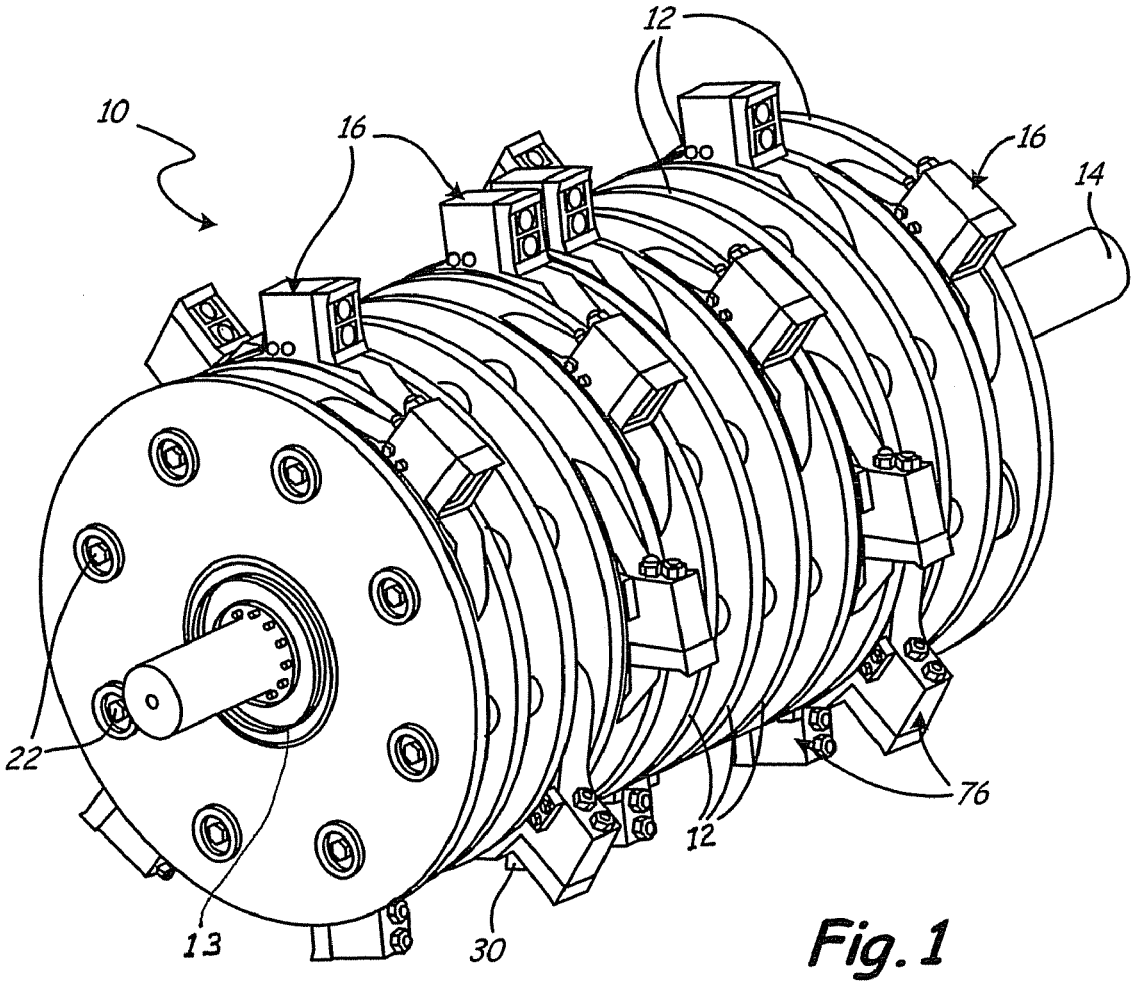
FIG. 1 is a perspective view of the cutting wheel device of the present invention.
Figure 2:
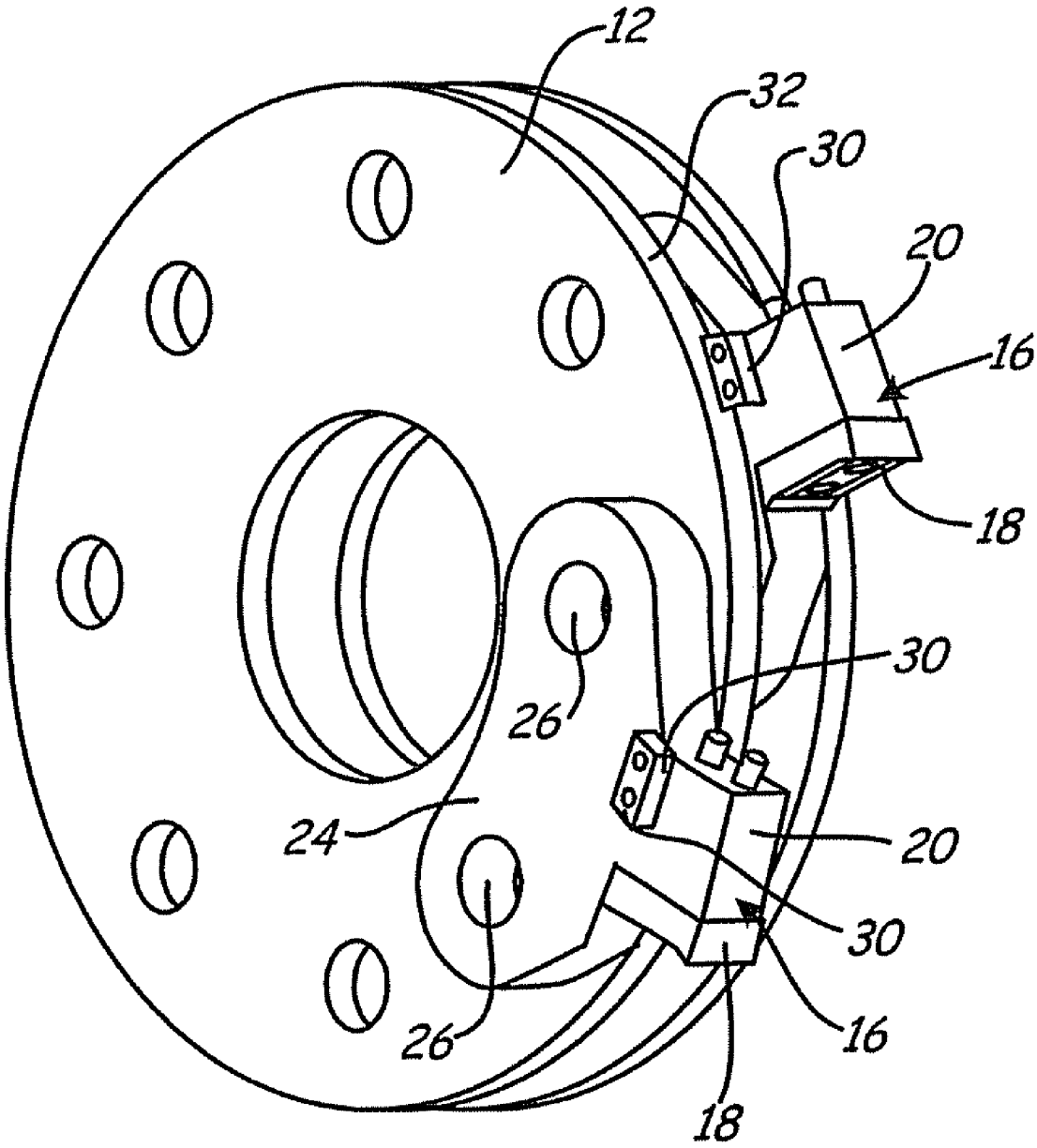
FIG. 2 is a perspective view of two discrete plates with cutting heads.

This disclosure relates to a cutting wheel design generally indicated at 10 in FIG. 1. The cutting wheel design is used in a grinder (not illustrated) that grinds material obtained from large-scale clearing of debris such as after damage from natural disasters or demolition at construction sites. In such situations it is often necessary to grind objects such as tree trucks and large branches, telephone poles, and wood debris from houses.

To grind such objects and materials, grinders have been developed that are powered by large diesel engines that rotate wide cylindrically shaped cutting wheels positioned to accept debris being fed from a conveying system or belt. The cutting wheel then grinds the debris until the debris becomes small enough to fall through a screen. Such large grinders are generally mounted on the back of a flat-bed truck trailer along with the engine and controls so that the grinder is movable to a debris containing site and within the debris containing site.

Figure 3:
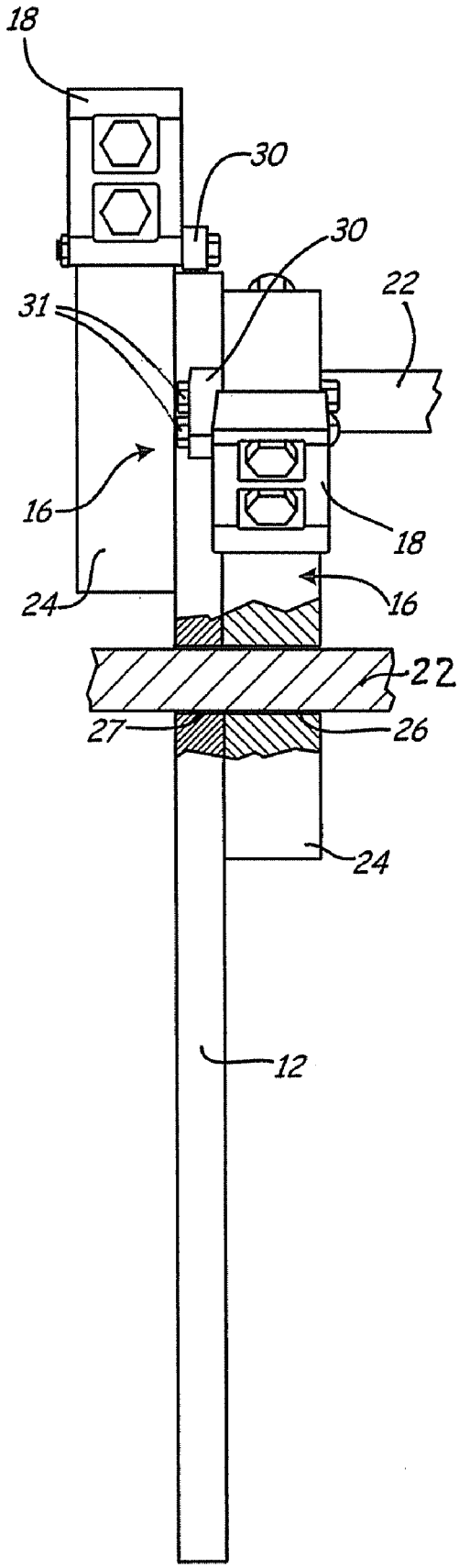
FIG. 3 is a partial sectional view of a discrete plate with two cutting heads.

The cutting wheel 10 is comprised of a plurality of circular discrete plates 12 which are mounted on an axle 14. Tool holders 16 are mounted on each of the discrete plates 12, as best illustrated in FIG. 3. The tool holders 16 include a hammer bit 18 mounted on a distal end portion 20. The distal end portion 20 projects beyond the periphery of the plate 12. The distal end portion 20 also has a mounting portion 24 which includes holes 26. The tool holders 16 are fastened to the plates 12 by hammer rods 22 that extend through holes 26 of the tool holder and holes 27 in plates 12. In the arrangement illustrated, eight hammer rods 22 are used to secure the tool holders and plates. More than one head 16 may be mounted on each individual plate 12 depending on the configuration of cutter heads desired for the cutting wheel.

The plates 12 are welded to a tube 13 which is fastened to the axle 14.

The end portion 20 and the attached blades 18 generally cover the space between adjacent discrete plates and do not extend to cover the space over the discrete plates 12. During operation, debris lodges between end portions 20 and the attached blades 18 over a common adjacent plate 12. To remedy this, the present invention includes a secondary cutter 30 for projecting over the edge of the plate 12. The secondary cutter is preferably mounted onto the cutting head 16 by bolts 31, preferably traversing almost the width (thickness) of the entire edge 32 of the plate 12 as best illustrated in FIG. 3. The positioning of the secondary cutting head 30 over the edge 32 keeps the space between cutting heads along the circumference of the plate 12 clear of debris.

Although the present invention has been described with reference to preferred embodiments, workers skilled in the art will recognize that changes may be made in form and detail without departing from the spirit and scope of the invention.

What is claimed is:

1. A cutting wheel device for grinding materials, the cutting wheel comprising:

a plurality of discrete plates mounted on an axle, each of the discrete plates having an outer peripheral surface;

a tool holder positioned between two of the plurality of discrete plates, the tool holder comprising a cutter head having a face extending radially and axially beyond the peripheral surface of the plates and having a blade extending therefrom for acting as a primary cutter; and a secondary cutter attached to the cutter head, the secondary cutter projecting over the peripheral surface of an adjacent discrete plate.

2. The cutting wheel device of claim 1 wherein the secondary cutter extends from the cutter head over the outer peripheral surface approximately a thickness of the adjacent plate.

* * * * *